US005258591A

United States Patent [19]

Buck

[11] Patent Number: 5,258,591

[45] Date of Patent: Nov. 2, 1993

[54] LOW INDUCTANCE CANTILEVER SWITCH

[75] Inventor: Daniel C. Buck, Hanover, Md.

[73] Assignee: Westinghouse Electric Corp., Pittsburgh, Pa.

[21] Appl. No.: 780,690

[22] Filed: Oct. 18, 1991

[51] Int. Cl.[5] ..... H01H 57/00

[52] U.S. Cl. ..... 200/181; 200/268; 200/269

[58] Field of Search ..... 200/181, 239, 245, 246, 200/262, 263, 267, 268, 269; 174/254, 261; 333/105, 258, 259, 262

[56] References Cited

U.S. PATENT DOCUMENTS

| | | | |
|---|---|---|---|
| 3,295,023 | 12/1966 | Peras | 200/181 |
| 3,413,497 | 11/1968 | Atalla | 200/181 |
| 3,539,705 | 11/1970 | Nathanson et al. | 174/254 |
| 3,796,976 | 3/1974 | Heng et al. | 333/161 |
| 4,112,279 | 9/1978 | Brohard | 200/181 |
| 4,480,162 | 10/1984 | Greenwood | 200/181 |
| 4,673,777 | 6/1987 | Bai et al. | 200/181 X |
| 4,674,180 | 6/1987 | Zavracky et al. | 29/622 |
| 4,680,438 | 7/1987 | Witting et al. | 200/268 |
| 4,922,253 | 5/1990 | Nathanson et al. | 342/5 |
| 4,959,515 | 9/1990 | Zavracky et al. | 200/181 |

FOREIGN PATENT DOCUMENTS

| | | | |
|---|---|---|---|
| 601771 | 3/1978 | U.S.S.R. | 200/181 |
| 289021 | 6/1929 | United Kingdom | 200/268 |
| 462442 | 3/1937 | United Kingdom | 200/268 |

OTHER PUBLICATIONS

Semiconductor unit switches mechanically, Electronics Dec. 21, 1978 vol. 51, No. 26, pp. 32, 33.

*Primary Examiner*—Henry J. Recla
*Assistant Examiner*—Glenn T. Barrett

[57] ABSTRACT

An apparatus is disclosed for providing an electrostatically actuated mechanical switch utilizing a cantilever beam element fabricated by solid-state microfabrication techniques. The apparatus reduces the required pull down voltage and lowers the switch inductance by separating the pull down electrode and contact pad. The pull down electrode is placed further away from the fulcrum of the cantilever beam then the contact pad to optimize the mechanical advantages which allow for a reduced pull down voltage. The contact pad is placed closer to the cantilever fulcrum to reduce the associated switch inductance. The gap between the contact pad and the cantilever beam is less then the gap between the pull down electrode and the cantilever beam to insure that the cantilever makes first contact with the contact pad.

19 Claims, 1 Drawing Sheet

LOW INDUCTANCE CANTILEVER SWITCH

BACKGROUND OF THE INVENTION

1. Field of the Invention

The present invention relates generally to electrostatically actuated cantilever switches and more particularly relates to microwave stripline switches capable of actuation with reduced voltage requirements and lower switch impedance.

2. Description of the Related Art

Changes in integrated circuits have been possible due to recent developments in microfabrication techniques. These changes have been addressed to making the devices smaller, more efficient, and capable of large scale production at low cost. More specifically, micromachining includes the techniques of planar technology, wet chemical etching and other etching techniques, metalization, and metal deposition.

The present inventive concept includes a basic electrostatically actuated cantilever switch. The uses for this type of switch vary from reactive (especially inductive and/or tuned) elements, microrelays, microsensors, to microsized switches in microwave stripline circuits.

It is well known in the prior art to fabricate in a batch process microelectronic switches.

Prior art methods of configuring electrostatically actuated switches have included microstrip lines divided into a number of short sections, each capacitively coupled to its neighbor by a cantilever switch. The cantilever makes contact with an element which serves as both the pull down electrode and the contact pad.

Other prior art uses the electrostatically actuated cantilever switch with the pull down electrode and the contact pad split into two separate elements. However, these elements have been arranged in a manner that placed the pull down electrode under the middle portion of the cantilever beam. The contact pad was placed under the unattached end of the cantilever beam. In other words, the contact pad was placed further from the cantilever fulcrum then what the pull down electrode was placed.

The U.S. Pat. No. 3,539,705 issued to H. C. Nathanson et al., on Nov. 10, 1970, entitled, "Microelectronic Conductor Configurations and Method of Making the Same" describes small air gap metal structures batch fabricated as part of a microelectronic component. These spaced metal elements can be optionally closed by compression bonding.

U.S Pat. No. 3,796,976 to Heng, et al., issued Mar. 12, 1974, entitled "Microwave Stripline Circuits with Selectively Bondable Micro-Sized Switches for In Situ Tuning and Impedance Matching", describes a microstrip line divided into a multiplicity of short sections, each capacitively coupled to its neighbor by a cantilever switch. These novel switches were of a predetermined length, (equal to fractions of a desired wavelength) and are connected together to shift the phase of energy propagating along their length thereby tuning and impedance matching the microstrip circuits.

U.S Pat. No. 4,674,180 to Zavracky et al., issued Jun. 23, 1987, entitled "Method of Making a Micromechanical Electric Shunt", describes a miniature electrical shunt exhibiting hysteresis taking the form of a modified cantilever beam element fabricated by microfabrication and micromachining techniques.

As can be seen in the above referenced patents, it is well known in the prior art to fabricate compression bonded microelectronic switches. However, the configuration of these switches results in higher voltages than necessary for actuation.

An object of the present invention is to provide an electrostatically actuated cantilever switch with a reduce pull down voltage.

Another object of the present invention is to provide an electrostatically actuated cantilever switch with a low impedance.

These and other objects are accomplished by an electrostatically actuated cantilever switch, which comprises: an insulating substrate with a pull down electrode and a contact pad attached to the substrate top surface. A cantilever beam element which has a first end portion attached to the substrate top surface. The cantilever element has an opposite end portion extending over but not touching the pull down electrode. Additionally, the cantilever element has a center portion extending between the first and second end portions positioned over but not touching the contact pad. A means for establishing an electrostatic charge attraction between the cantilever beam and the pull down electrode is used. This results in the end portion of the cantilever element deflecting towards the pull down electrode. The deflection in the cantilever element causes the cantilever element and the contact pad to make contact.

In another aspect of the present invention, the electrostatically actuated switch serves as a better baseline element for use in phase shift methods.

These and other features and advantages of the present invention will become more apparent with reference to the following detailed description and drawings.

SUMMARY of THE INVENTION

The preferred and alternative embodiments of the present invention address the needs for miniature electrical cantilever switches with a low pull down voltage and low inductance. The uses for such a cantilever configuration vary from use in an electromagnetic shutter to integrated switches across a slot line by adoption of microfabrication techniques in the manufacture of one or more cantilever elements in association with a substrate.

The electrostatically actuated mechanical switch of the present invention takes the form of a modified cantilever beam element fabricated by solid-state microfabrication techniques. One or more metallic cantilevered elements may be joined on a single substrate. The substrate is normally an insulating material such as glass or similar material. The cantilever beam element is attached at one end and free to move at the other end. Under the free end of the cantilever element, and attached to the substrate, is a pull down electrode or electrical force plate. Additionally, under the free end of the cantilever element, and attached to the substrate, is a contact pad which is located between the attached end of the cantilever element and the pull down electrode. The contact pad is thicker than the pull down electrode. Therefore, the contact pad is closer than the pull down electrode to the cantilever element. Electrical contact is made with the fixed end of the cantilever element and with the pull down electrode, and an electrostatic charge applied to the two elements. The free end of the cantilever element and the pull down electrode are drawn towards one another by the electrostatic force of the charge applied to the two elements. The pull down electrode is attached to the substrate and the free end of the cantilever element is free to move, thus only the cantilever free end is deflected towards the pull down electrode. However, as a result of the contact pad being both closer to the attached end of the cantilever element and thicker than the pull down electrode, the cantilever element deflects until it contacts the contact pad. The cantilever element does not come into contact with the pull down electrode. A plurality of cantilever elements may be fabricated surrounding a common pull down electrode.

BRIEF DESCRIPTION OF THE DRAWINGS

The above, as well as other features and advantages of the present invention, will become apparent through consideration of the detailed description in connection with the accompanying drawings. Throughout the drawings, like reference numerals depict like elements. In the drawings.

DETAILED DESCRIPTION OF THE PREFERRED EMBODIMENTS

Figure 1:
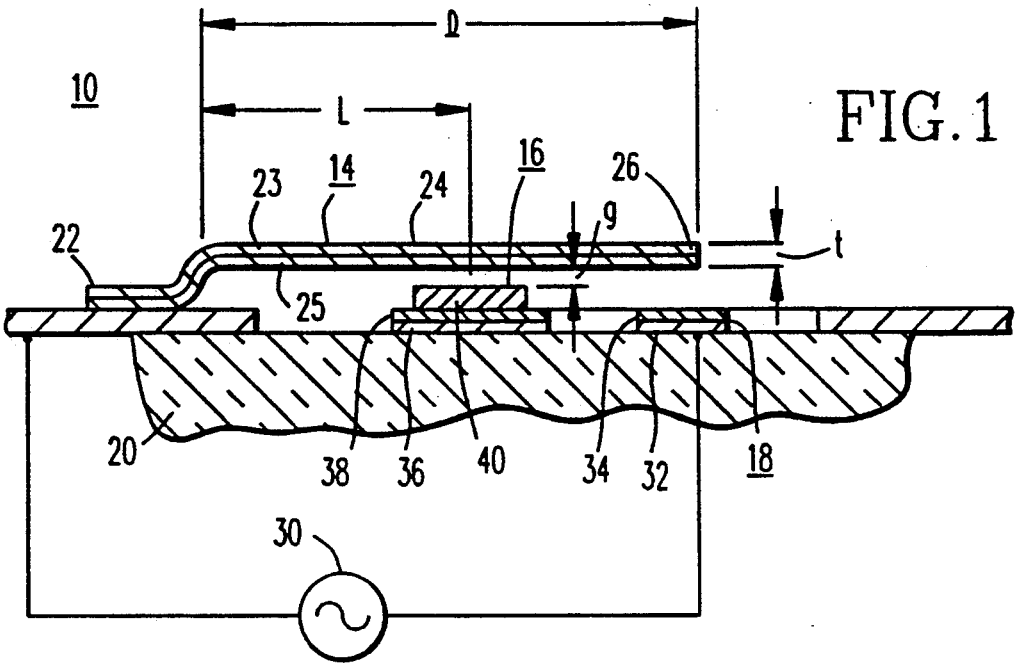
FIG. 1 is a simplified cross-section of an electrostatically actuated cantilever switch.
Figure 2:
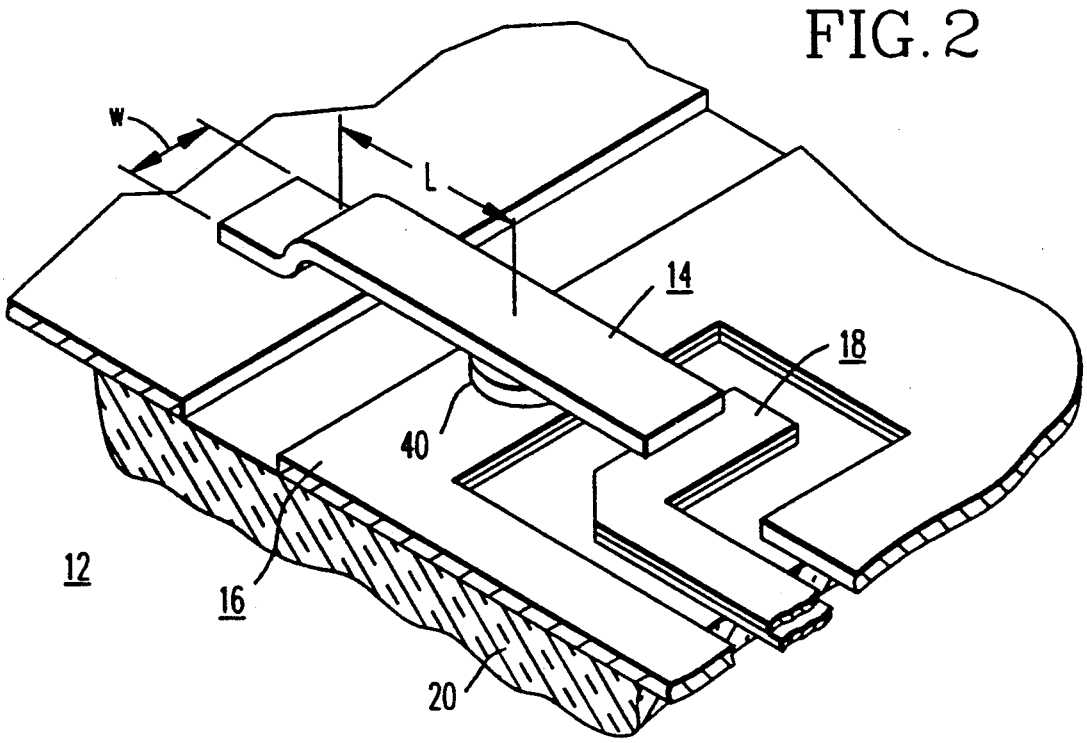
FIG. 2 is a diagrammatic view of an electrostatically actuated cantilever switch as a circuit element in a slot guide.

FIG. 1 illustrates pictorially the essential elements of the electrostatically actuated cantilever switch 10, while FIG. 2 illustrates the same cantilever switch 10 in use as a circuit element in a slot guide 12. The fabrication and usage of microstrip lines are well known in the art and will not be discussed in detail herein.

In the preferred embodiment of the present invention (FIG. 1) the purpose of cantilever switch 10 is to couple and decouple the cantilever element 14 to the contact pad 16. Cantilever element 14 is comprised of a first end portion 22, an opposite second end portion 26, and a center portion 24 extending between the first 22 and second 26 end portions. The purpose of the disclosed invention is to reduce the pull down voltage required to actuate the cantilever switch 10, while reducing the cantilever switch 10 inductance and to prevent accidental shorting of the cantilever element 14 to the pull down electrode. This will be discussed in more detail below with regard to a particular embodiment of the present invention.

The electrostatically actuated cantilever switch 10 of the present invention is formed by solid-state microfabrication techniques. One or more metallic cantilevered elements 14 may be joined on a single substrate 20. The substrate 20 is normally an insulating material such as glass or similar material. The cantilever element 14 is attached at the first end portion 22 and free to move at the opposite second end portion 26. Under the opposite second end portion 26 of the cantilever element 14, and disposed upon the substrate 20, is a pull down electrode 18 or electrical force plate 18. Additionally, under the center portion 24 of the cantilever element 14, and disposed upon the substrate 20, is a contact pad 16 which is located between the attached first end portion 22 of the cantilever element 14 and the pull down electrode 18. The contact pad 16 is thicker than the pull down electrode 18. Therefore, the contact pad 16 is closer than the pull down electrode 18 to the cantilever element 14.

The coupling and decoupling of the cantilever element 14 and the contact pad 16 is accomplished by means of an electrostatic charge applied to the first end portion 22 of the cantilever element 14 and with the pull down electrode 18. The opposite second end portion 26 of the cantilever element 14 and the pull down electrode 18 are drawn towards one another by the electrostatic force of the charge applied to the two elements. The pull down electrode 18 is attached to the substrate 20 and the opposite second end portion 26 of the cantilever element 14 is free to move, thus only the cantilever element 14 second end portion 26 is deflected towards the pull down electrode 18. However, as a result of the contact pad 16 being both closer to the attached first end portion 22 of the cantilever element 14 and thicker than the pull down electrode 18, the center portion 24 of the cantilever element 14 deflects until it contacts the contact pad 16. The opposite second end portion 26 of the cantilever element 14 is deflected towards but does not come into contact with the pull down electrode 18. Therefore, the cantilever element 14 is prevented from shorting to the pull down electrode. A plurality of cantilever elements 14 may be fabricated surrounding a common pull down electrode 18.

The means for providing the electrostatic charge 30 between the cantilever element 14 and the pull down electrode 18 is shown in FIG. 1 by an electrical power supply 30 which may be a DC source of potential.

The pull down voltage required to close an electrostatic switch is a function of the length of the cantilever element 14 from the fulcrum of the cantilever element 14 to the pull down electrode 18, the air gap between the pull down electrode 18 and the cantilever element 14, the cantilever element 14 thickness, and the cantilever elements 14 stiffness factor and moment of inertia. By increasing the distance between the fulcrum of the cantilever element 14 and the pull down electrode 18 in the present invention, well known mechanical principles allow for a reduced force to actuate the cantilever switch 10. In the present invention this advantage is realized by placing the pull down electrode 18 further away from the attached first end portion 22 of the cantilever element 14 than the contact pad 16.

The impedance of the cantilever switch 10 is reduced by decreasing the length of the cantilever element 14 as measured from the cantilever fulcrum to the contact point of the contact pad 16. This smaller "L" gives a smaller inductance. The present invention takes advantage of this electrical principle by placing the contact pad 16 closer than the pull down electrode 18 to the attached first end portion 22 of the cantilever element 14, allowing for a smaller "L" than previously possible in the prior art.

For the electrostatically actuated cantilever switch 10 as shown in FIGS. 1 and 2, the values of an exemplary switch, 10 for example would have the following ranges:

$g$=2–3 microns $l$=30–150 microns $w$=5–50 microns $t$=1–4 microns where g is the spacing between the contact pad 16 and the cantilever element 14 in the normal undeflected positions;

l is the cantilever element 14 length from the fulcrum to a point over the pull down electrode;

w is the width of the cantilever element 14; and t is the thickness of the cantilever element 14.

The materials for manufacturing a preferred embodiment of the cantilever switch 10 are as follows:

The cantilever element 14 may be manufactured in two layers, a first layer 25 of platinum and a second layer 23 of gold. The first layer 25 of the cantilever element 14 is on the bottom side of the cantilever element 14 so as to be the surface which contacts the contact pad 16. The second layer 23 of gold is attached to the first layer 25. Gold is used for the second layer 23 because it is an excellent conductor, does not oxidize, and does not harden through repeated flexing so long as the stress point is not exceeded.

The pull down electrode 18 may be manufactured in two layers, a first layer 32 and a second layer 34. The first layer 32 consist of titanium for providing a strong attachment to the insulating substrate 20. A second layer 34 of gold is attached to the first layer 32. The gold serves as a reliable conductor.

The contact pad 16 may be manufactured in three layers, a first layer 36, a second layer 38, and a third layer 40. The first 36 and second 38 layers are the same as used for the pull down electrode 18. The third layer 40 is platinum. Platinum is used to prevent the cantilever element 14 from sticking to the contact pad 16. Platinum is a good conductor and more durable than gold. The platinum to platinum contact between the cantilever element 14 first layer 25 and the contact pad 16 third layer 40 has excellent wear characteristics.

Thus, it is intended by the following claims to cover all such modifications and adaptations which fall within the true spirit and scope of the invention.

What is claimed is:

1. A cantilever switch comprising:

(a) an insulating substrate having a top surface;

(b) a pull down electrode mounted on said top surface of said insulating substrate;

(c) a cantilever element having a first end portion secured to said top surface of said insulating substrate, an opposite second end portion positioned in spaced relation to said pull down electrode and operable in response to an electrostatic charge established between said cantilever element and said pull down electrode to deflect in a direction towards said pull down electrode, said cantilever element comprising a first layer consisting of platinum positioned above and facing said insulating substrate and a second layer consisting of gold attached to said first layer; and (d) a contact pad mounted on said top surface of said insulating substrate between said cantilever element first end portion and said pull down electrode and positioned to contact said cantilever element as said cantilever element deflects towards said pull down electrode.

2. A cantilever switch as recited in claim 1, wherein said cantilever element includes a center portion extending between said first and second end portions and operable to contact said contact pad as said cantilever element deflects towards said pull down electrode.

3. A cantilever switch as recited in claim 2, wherein:

(a) said center portion of said cantilever element is positioned a predetermined distance from said contact pad;

(b) said second end portion of said cantilever element is positioned a predetermined distance from said pull down electrode; and (c) said predetermined distance between said center portion of said cantilever element and said contact pad is less than said predetermined distance between said second end portion of said cantilever element and said pull down electrode.

4. A cantilever switch as recited in claim 3, wherein the predetermined distance between said cantilever element and said contact pad is between 2 microns and 3 microns.

5. A cantilever switch as recited in claim 4, wherein said electrostatic charge is established by a DC power supply.

6. A cantilever switch as recited in claim 1, wherein said cantilever element has a length of between 30 and 150 microns.

7. A cantilever switch as recited in claim 1, wherein said cantilever element width is between 5 microns and 50 microns.

8. A cantilever switch as recited in claim 1, wherein said cantilever element is between 1 micron and 4 microns in thickness.

9. A cantilever switch as recited in claim 1 which further includes means for establishing an electrostatic charge between said cantilever element and said pull down electrode.

10. A cantilever switch as recited in claim 1, wherein the contact pad comprises:

(a) a first layer consisting titanium attached to said top surface of said insulating substrate;

(b) a second layer consisting gold attached to said first layer; and (c) a third layer consisting platinum attached to said second layer.

11. A cantilever switch as recited in claim 1, wherein the pull down electrode comprises:

(a) a first layer consisting titanium attached to said top surface of said insulating substrate; and (b) a second layer consisting gold attached to said first layer.

12. A cantilever switch comprising:

(a) an insulating substrate having a top surface;

(b) a pull down electrode mounted on said top surface of said insulating substrate;

(c) a cantilever element having a first end portion secured to said top surface of said insulating substrate, an opposite second end portion positioned in spaced relation to said pull down electrode and operable in response to an electrostatic charge established between said cantilever element and said pull down electrode to deflect in a direction towards said pull down (d) a contact pad mounted on said top surface of said insulating substrate between said cantilever element first end portion and said pull down electrode and positioned to contact said cantilever element as said cantilever element deflects towards said pull down electrode, said contact pad comprising a first layer consisting of titanium attached to said top surface of said insulating substrate, a second layer consisting of gold attached to said first layer and a third layer consisting of platinum attached to said second layer; and (e) means for establishing an electrostatic charge attraction between said cantilever element and said pull down electrode.

13. A cantilever switch as recited in claim 12, wherein the gap between said contact pad and said cantilever element is less than the gap between said pull down electrode and said cantilever element.

14. A cantilever switch as recited in claim 13, wherein the gap between said cantilever element and said contact pad is between 2 microns and 3 microns.

15. A cantilever switch as recited in claim 13, wherein said cantilever element has a length of between 30 and 150 microns.

16. A cantilever switch as recited in claim 13, wherein said cantilever element width is between about 5 microns and 50 microns.

17. A cantilever switch as recited in claim 13, wherein said cantilever element is between 1 micron and 4 microns in thickness.

18. A cantilever switch comprising:

(a) an insulating substrate having a top surface;

(b) a pull down electrode mounted on said top surface of said insulating substrate, said pull down electrode comprising a first layer consisting of titanium attached to said top surface of said insulating substrate, a second layer consisting of gold attached to said first layer;

(c) a contact pad mounted on said top surface of said insulating substrate; between said cantilever element first end portion of said pull down electrode and positioned to contact said cantilever element as said cantilever element deflects towards said pull down electrode;

(d) a cantilever element having a first end portion affixed to said insulating substrate, an opposite second end portion extending over but spaced from said pull down electrode, and a center portion extending between said first and second end portions positioned over but spaced from said contact pad; and (e) means for establishing an electrostatic charge attraction between said cantilever element and said pull down electrode;

whereby said end portion of said cantilever element may be deflected towards said pull down electrode by establishing an electrostatic charge between said cantilever element and said pull down electrode;

whereby said cantilever element contacts said contact pad.

19. A cantilever switch as in claim 18, wherein the gap between said contact pad and said cantilever element is less than the gap between said pull down electrode and said cantilever element.

* * * * *